US010066625B2

(12) United States Patent
Cho et al.

(10) Patent No.: US 10,066,625 B2
(45) Date of Patent: Sep. 4, 2018

(54) COMPRESSOR

(71) Applicant: Samsung Electronics Co., Ltd, Gyeonggi-do (KR)

(72) Inventors: Yang Hee Cho, Gyeonggi-do (KR); Yang Sun Kim, Gyeonggi-do (KR); Moo Seong Bae, Gyeonggi-do (KR); Sung Hea Cho, Gyeonggi-do (KR); Jong Cheun Seo, Gyeonggi-do (KR); Tae Hoon Choi, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 113 days.

(21) Appl. No.: 15/191,492

(22) Filed: Jun. 23, 2016

(65) Prior Publication Data

US 2016/0377081 A1 Dec. 29, 2016

(30) Foreign Application Priority Data

Jun. 23, 2015 (KR) ..... 10-2015-0088965

(51) Int. Cl.
*F01C 1/02* (2006.01)
*F01C 1/063* (2006.01)
(Continued)

(52) U.S. Cl.
CPC ..... *F04C 29/02* (2013.01); *F04C 18/0215* (2013.01); *F04C 18/0253* (2013.01);
(Continued)

(58) Field of Classification Search
USPC ..... 418/55.1–55.6, 270, DIG. 1, 94, 57
See application file for complete search history.

(56) References Cited

U.S. PATENT DOCUMENTS 9,435,340 B2 * 9/2016 Doepker ..... F04C 18/0207
2004/0265159 A1 * 12/2004 Furusho ..... F04C 18/0215 418/55.5
2013/0209303 A1 * 8/2013 Tsuka ..... F04C 18/0215 418/55.1

FOREIGN PATENT DOCUMENTS

EP 1 158 167 A1 11/2001
EP 2 163 766 A2 3/2010
(Continued)

OTHER PUBLICATIONS

European Patent Office, "European Search Report," Application No. 16175837.0, dated Dec. 6, 2016, 7 pages, publisher EPO, Munich, Germany.

(Continued)

*Primary Examiner* — Deming Wan

(57) ABSTRACT

Disclosed herein is an a compressor including a main body, a fixed scroll fixed on the inside of the main body, an orbiting scroll arranged to orbit relative to the fixed scroll, a compressing chamber formed by the fixed scroll and the orbiting scroll, an oil supply hole arranged to supply oil to a contact portion formed by the fixed scroll and the orbiting scroll, and an oil groove formed on an inner side of the contact portion to be closed to an outer side of the contact portion. The oil groove is extended into the form of an arc by being rotated by about 270 degrees or more along the circumference of the fixed scroll to cover the compressing chamber from the outside of the compressing chamber to supply oil all across the area of the contact portion easier which leads to more reliable operation of the compressor.

16 Claims, 17 Drawing Sheets

(51) Int. Cl.

| | |
|---|---|
| ***F03C 2/02*** | (2006.01) |
| ***F04C 18/02*** | (2006.01) |
| ***F01C 21/04*** | (2006.01) |
| ***F04C 29/02*** | (2006.01) |
| ***F04C 23/00*** | (2006.01) |
| ***F04C 29/12*** | (2006.01) |

(52) U.S. Cl.
CPC ..... *F04C 23/008* (2013.01); *F04C 29/023* (2013.01); *F04C 29/028* (2013.01); *F04C 29/12* (2013.01); *F04C 2240/30* (2013.01)

(56) References Cited

FOREIGN PATENT DOCUMENTS

| | | | |
|---|---|---|---|
| EP | 2 863 059 | A1 | 4/2015 |
| JP | H11182432 | A | 7/1999 |
| JP | 2002-089449 | | 3/2002 |
| WO | 2014-051085 | A1 | 4/2014 |

OTHER PUBLICATIONS

European Patent Office, "Communication pursuant to Article 94(3) EPC," Application No. EP 16 175 837.0, dated Jun. 9, 2017, 6 pages.
Communication under Rule 71(3) EPC dated Nov. 14, 2017 in connection with European Patent Application No. 16 175 837.0.

* cited by examiner

50

COMPRESSOR

CROSS-REFERENCE TO RELATED APPLICATION(S) AND CLAIM OF PRIORITY

The present application is related to and claims priority to and the benefit of Korean Patent Application No. 10-2015-0088965, filed on Jun. 23, 2015, the disclosure of which is incorporated herein by reference in its entirety.

TECHNICAL FIELD

The present disclosure relates to compressors, and more particularly, to an oil supply structure of a scroll compressor.

BACKGROUND

A scroll compressor is a device for compressing refrigerants by relative movements between fixed and orbiting scrolls each having a spiral wrap. The scroll compressor is widely used in refrigeration cycle devices because it has a higher efficiency, lower vibration and noise, smaller size, and lighter weight than reciprocating compressors or rotary compressors.

The scroll compressor has a compressing chamber formed by the fixed scroll contained in an airtight container and the orbiting scroll that orbits with respect to the fixed scroll. The compressing chamber is tapered from the outer circumferential side to the inner circumferential side by rotation of the orbiting scroll. Refrigerants are compressed after being sucked in from the outer circumferential side, and then discharged from the center of the compressing chamber into the airtight container.

Since the fixed scroll and the orbiting scroll are closely attached and circled to each other, oil should be supplied to a part where friction is caused between the fixed scroll and the orbiting scroll for smooth operation.

At this time, if the oil supply to the part of friction is not working properly, reliability in operation of the scroll compressor may not be secured.

SUMMARY

To address the above-discussed deficiencies, it is a primary object to provide an effective oil supply structure between scrolls of a compressor.

The present disclosure also provides an effective valve structure for controlling refrigerants not to flow backward when operation of the compressor is suspended.

In accordance with one aspect of the present disclosure, an compressor may include a main body, a fixed scroll fixed on the inside of the main body, an orbiting scroll arranged to orbit relative to the fixed scroll, a compressing chamber formed by the fixed scroll and the orbiting scroll, an oil supply hole arranged to supply oil to a contact portion formed by the fixed scroll and the orbiting scroll and an oil groove formed on an inner side of the contact portion to be closed to an outer side of the contact portion, wherein the oil groove is extended into the form of an arc by being rotated by about 270 degrees or more along the circumference of the fixed scroll to cover the compressing chamber from the outside of the compressing chamber.

The oil groove may include one end of the oil groove is formed to be adjacent to the oil supply hole, and an oil supply portion formed to be adjacent to the one end of the oil groove, which comes into contact with the oil supply hole at least twice or more while the orbiting scroll orbits.

The oil groove may further include an auxiliary oil groove that is extended from a side of the oil supply portion and comes into contact with the oil supply hole at least one time or more while the orbiting scroll orbits.

The auxiliary oil groove may include at least one bending portion that bends to a side from a direction in which the auxiliary oil groove extends from the oil groove.

The auxiliary oil groove is bent to come into contact with the oil supply hole at least twice or more while the orbiting scroll orbits.

The other end of the oil groove is rotated and extended to a position corresponding to the oil supply portion.

The oil supply portion may include a plurality of oil supply portions, and the plurality of oil supply portions include a first oil supply portion arranged on one end of the oil groove, and a second oil supply portion formed on the other end of the oil groove and located to correspond to the first oil supply portion.

The oil groove may further include an incision portion located between the first and second oil supply portions for cutting the oil groove.

The oil supply hole may include a plurality of oil supply holes, and the plurality of oil supply holes includes a first oil supply hole formed on the orbiting scroll, and a second oil supply hole formed separately from the first oil supply hole, and the oil groove is formed to come into contact with each of the first and second oil supply holes at least twice or more while the orbiting scroll orbits.

The oil groove may further include an incision portion located between the first and second oil supply holes for cutting the oil groove.

The compressor may further include a discharging hole formed above the fixed scroll for discharging refrigerants compressed by the compressing chamber and a valve unit formed above the discharging hole for preventing discharged refrigerants from flowing backward to the discharging hole while operation of the compressor is stopped.

The valve unit may include a valve to prevent refrigerants from flowing backward by moving up and down alternately from the discharging hole, a valve guide for guiding the valve and a buffer member arranged between the discharging hole and the valve.

The valve moves up and down alternately between the valve guide and the buffer member.

The buffer member comprises a through tube through which refrigerants discharged from the discharging hole pass.

In accordance with another aspect of the present disclosure, an compressor may include a main body, a fixed scroll that is fixed on the inside of the main body and has a fixed wrap, an orbiting scroll that orbits relative to the fixed scroll and includes an orbiting wrap to form a compressing chamber with the fixed wrap, an oil supply hole arranged to supply oil to a contact portion formed by the fixed scroll and the orbiting scroll and an oil groove formed on an inner side of the contact portion to be closed on the contact portion, one end of the oil groove being formed to be adjacent to the oil supply hole, and the other end of the oil groove being rotated and extended to an outer side of the compressing chamber, wherein a distance between the other end of the oil groove and the oil supply hole is formed to be longer than a distance between an outer end of the orbiting wrap and the oil supply hole.

The other end of the oil groove is extended by being rotated by about 270 degrees or more with respect to the one end of the oil groove.

The compressor may further include a part adjacent to the one end of the oil groove comes into contact with the oil supply hole at least twice or more while the orbiting scroll orbits.

The oil groove comprises an auxiliary oil groove that is extended from a side of a part adjacent to the one end of the oil groove and comes into contact with the oil supply hole at least one time or more while the orbiting scroll orbits.

The other end of the oil groove is rotated and extended to a position corresponding to an orbit path of the oil supply hole.

The compressor may further include a discharging hole formed above the fixed scroll for discharging refrigerants compressed by the compressing chamber and a valve unit formed above the discharging hole for preventing discharged refrigerants from flowing backward to the discharging hole while operation of the compressor is stopped.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
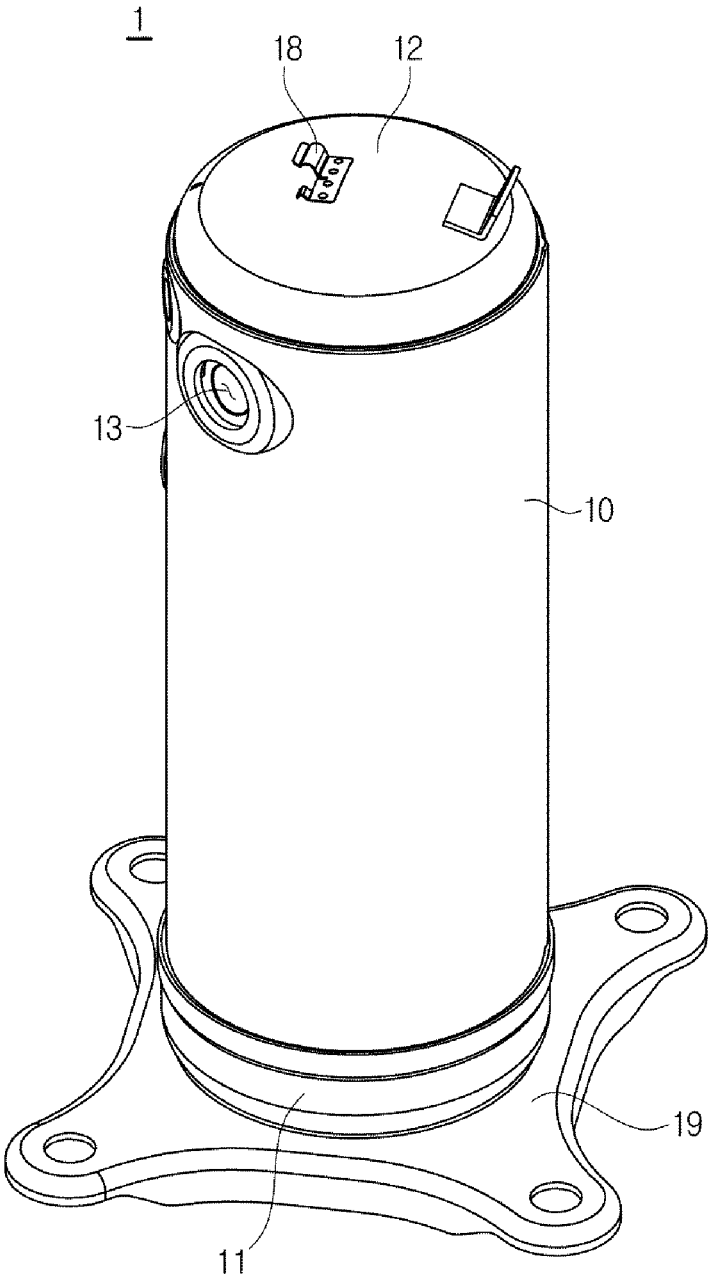
FIG. 1 illustrates a perspective view of a compressor, according to an embodiment of the present disclosure.

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged compressor. Embodiments and features as described and illustrated in the present disclosure are examples, and various modifications thereof may also fall within the scope of the disclosure.

Throughout the drawings, like reference numerals refer to like parts or components.

The terminology used herein is for the purpose of describing particular embodiments and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are for the purpose of distinguishing a component from another. Thus, a first element, component, region, layer or section discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

Reference will now be made in detail to embodiments, examples of which are illustrated in the accompanying drawings, wherein like reference numerals refer to the like elements throughout.

Figure 2:
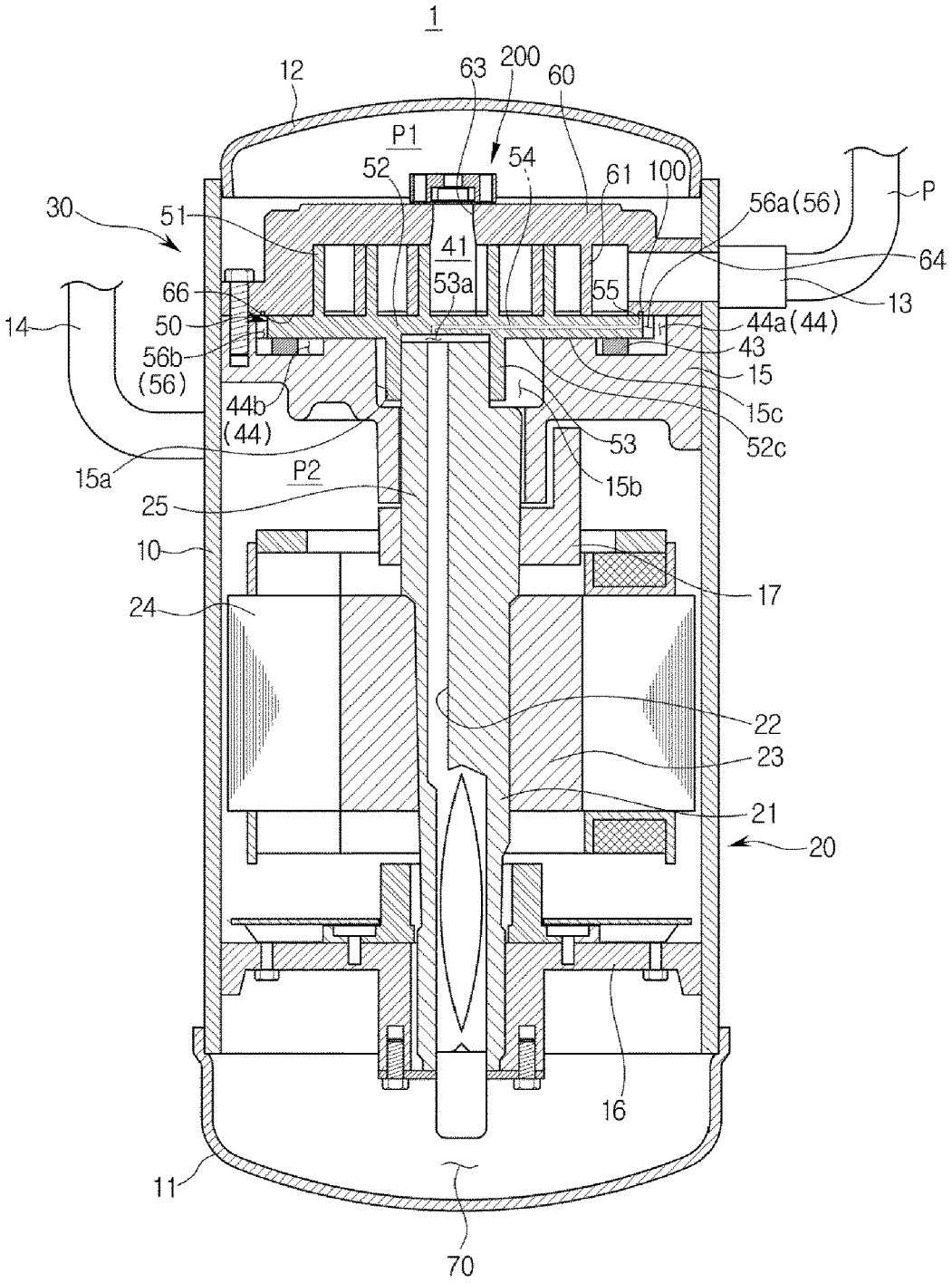
FIG. 2 illustrates a side cross-sectional view of a compressor, according to an embodiment of the present disclosure.
Figure 3:
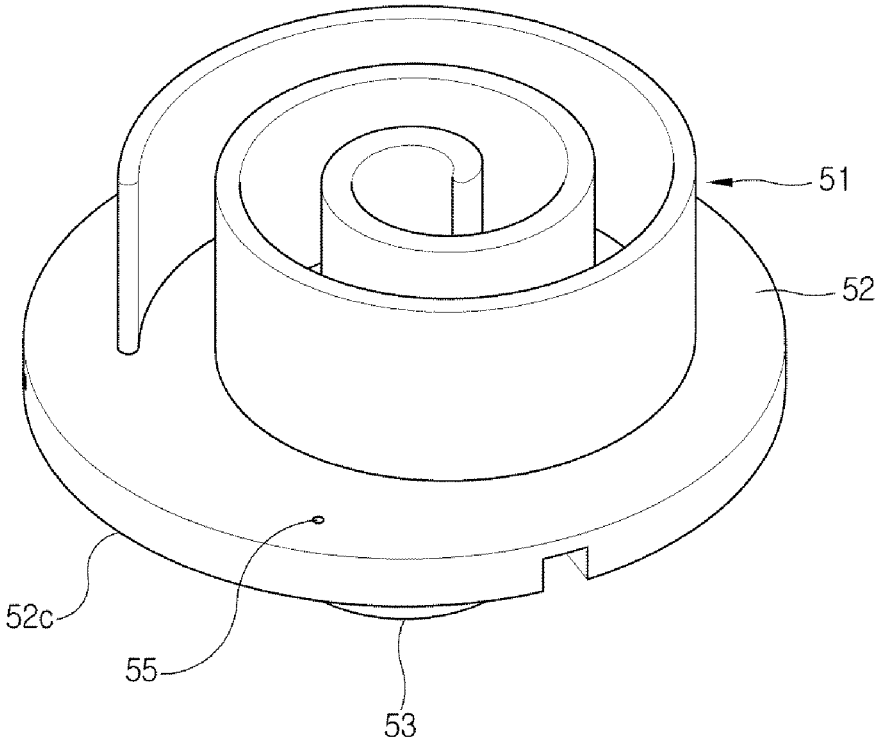
FIG. 3 illustrates a perspective view of a bottom part of an orbiting scroll of a compressor, according to an embodiment of the present disclosure.
Figure 4:
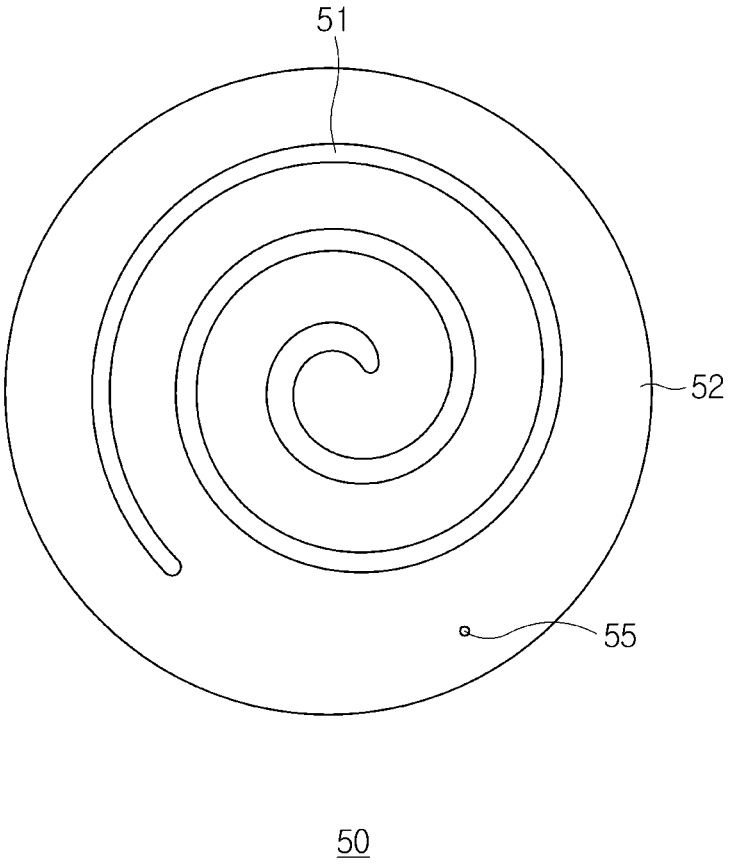
FIG. 4 illustrates a plan view of a bottom part of an orbiting scroll of a compressor, according to an embodiment of the present disclosure.
Figure 5:
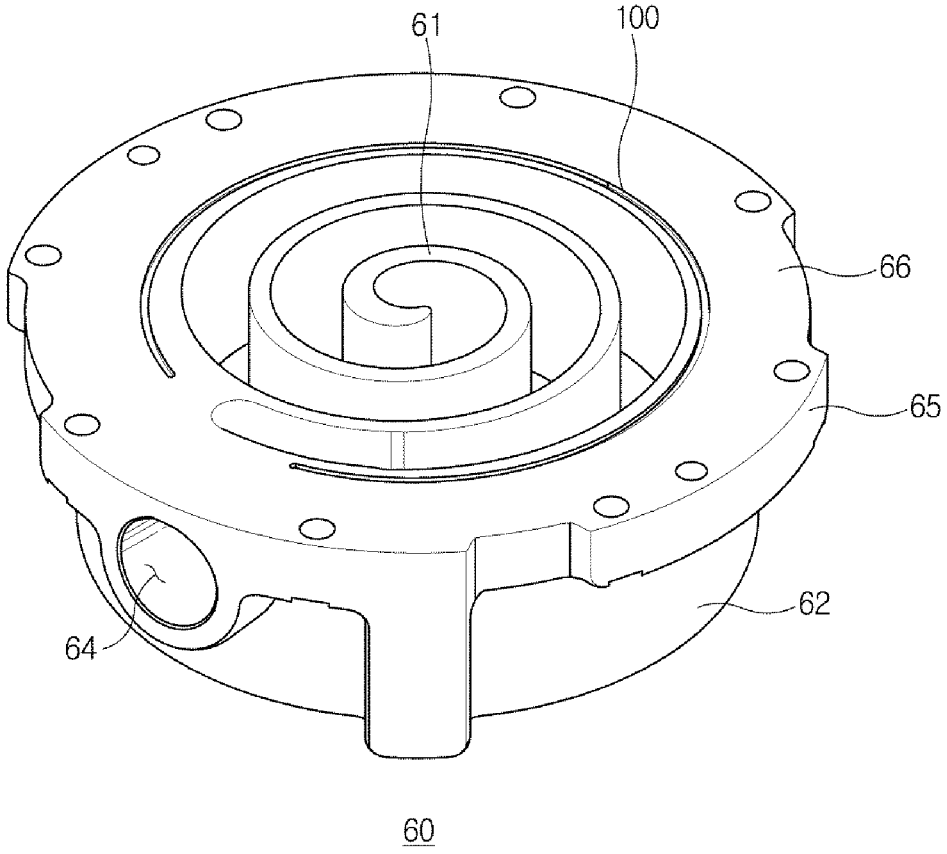
FIG. 5 illustrates a perspective view of a fixed scroll of a compressor, according to an embodiment of the present disclosure.
Figure 6:
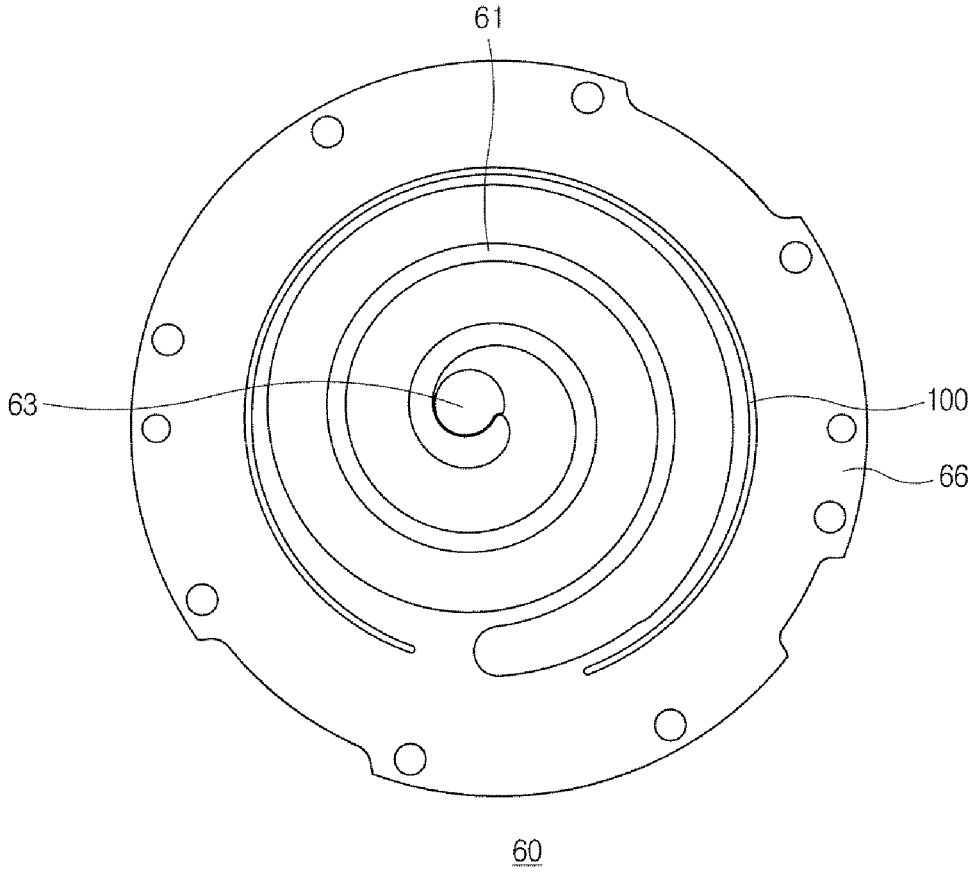
FIG. 6 illustrates a plan view of a fixed scroll of a compressor, according to an embodiment of the present disclosure.

FIG. 1 illustrates a perspective view of a compressor, according to an embodiment of the present disclosure, FIG. 2 illustrates a side cross-sectional view of a compressor, according to an embodiment of the present disclosure, FIG. 3 illustrates a perspective view of a bottom part of an orbiting scroll of a compressor, according to an embodiment of the present disclosure, FIG. 4 illustrates a plan view of a bottom part of an orbiting scroll of a compressor, according to an embodiment of the present disclosure, FIG. illustrates is a perspective view of a fixed scroll of a compressor, according to an embodiment of the present disclosure, FIG. 6 illustrates a plan view of a fixed scroll of a compressor, according to an embodiment of the present disclosure.

Referring to FIGS. 1 to 6, a compressor 1 may include a main body 10 having an airtight room therein, an operation unit 20 located inside the main body 10, and a compression unit 30. The compressor 1 may include a fastening member 18 on the outer side of the compressor 1, so as to be installed on and secured to e.g., an outdoor unit of an air conditioner (AC). The compressor 1 may also include a bottom plate 19 to be safely seated and fixed on the bottom floor.

An inlet 13 for allowing refrigerants to flow in is formed on one side of the main body 10, while an outlet 14 for releasing refrigerants, which have flowed in through the inlet 13 and have been compressed, to the outside, is formed on the other side of the main body 10. A top cap 12 and a bottom cap 11 may be mounted on the top and the bottom, respectively, of the main body 10, to tightly shut the inside of the main body 10.

The operation unit 20 may include a stator 24 pressed down to be placed inside the main body 10, and a rotator 23 rotatably installed in the center of the stator 24. Balance weights 17 may be installed above and/or below the rotator 23, to control unbalanced rotation during rotation of the rotator 23.

A top flange 15 and a bottom flange 16 may be fixed in the upper part and the lower part of the inside of the main body 10, respectively. The operation unit 20 may be placed between the top and bottom flanges 15 and 16. A rotation shaft 21 is attached between the top and bottom flanges 15 and 16 for transferring torque produced from the operation unit 20 to an orbiting scroll 50 of the compression unit 30. An eccentric portion 25 may be formed in the upper part of the rotation shaft 21 to be eccentrically arranged from the center of the rotation shaft 21.

A through hole 15*a* may be formed in the center of the top flange 15 in order for the rotation shaft 21 to be installed to pass through. Around the through hole 15*a*, an oil storage 15*b* for storing oil sucked in though the rotation shaft 21 may be formed. An oil pipe 22 may be formed through the inside of the rotation shaft 21 in the axial direction of the rotation shaft 21. An oil pump (not shown) may be installed at a lower part of the oil pipe 22.

The compression unit 30 may include a fixed scroll 60 and an orbiting scroll 50 for orbiting relative to the fixed scroll 60, in order to compress refrigerants flowing to the inside of the main body 10. The fixed scroll 60 may be fixedly combined with the main body 10 to be located above the top flange 15, and the orbiting scroll 50 may be located between the fixed scroll 60 and the top flange 15 to be able to orbit relative to the fixed scroll 60. The orbiting scroll 50, into which the rotation shaft 21 is put, is driven by the rotation shaft 21, and an orbiting wrap 51 of a spiral form is formed on top of the orbiting scroll 50. On the bottom of the fixed scroll 60, there may be a fixed wrap 61 formed to be in gear with the orbiting wrap 51 of the orbiting scroll 50. Structures of the orbiting and fixed scrolls 50 and 60 will now be described in detail.

The orbiting scroll 50 and the fixed scroll 60 may form a compressing chamber 41 while the orbiting wrap 51 and the fixed wrap 61 is in gear with each other. An Oldham's ring container 44 may be arranged between the orbiting scroll 50 and the top flange 15. An Oldham's ring 43 may be contained in the Oldham's ring container 44 for making the orbiting scroll orbit while preventing rotation of the orbiting scroll 60.

The inside of the main body 10 is divided by the top flange 15 and fixed scroll 60 into an upper part P1 and a lower part P2, both of which are highly pressurized. A suction hole 64 is formed on one end of the fixed scroll 60 to join a gas suction pipe P connected to the inlet 13, and a discharging hole 63 is formed on the center of the top face of the fixed scroll 60 for discharging refrigerants compressed by the compressing chamber 41 to the upper part P1 of the main body 10. A valve unit 200 may be arranged to open/shut the discharging hole 63 to prevent the refrigerant gas being discharged from the discharging hole 63 from flowing backward. Details of the valve unit 200 will be described later.

When the compressor 1 is powered, the rotation shaft 21 rotates with the rotator 23, and the orbiting scroll 50 combined with the top of the rotation shaft 21 turns. Turning of the orbiting scroll 50 refers to an orbiting motion with orbit radius, which is a distance from the center of the rotation shaft 21 to the center of the eccentric portion 25. At this time, the Oldham's ring 43 prevents rotation of the orbiting scroll 50.

As the orbiting scroll 50 orbits relative to the fixed scroll 60, the compressing chamber 41 is formed between the orbiting wrap 51 and the fixed wrap 61. The compressing chamber 41 compresses refrigerants that have been sucked in as the volume of the compressing chamber 41 is reduced while the compressing chamber 41 is moving to the center by continual orbiting motion of the orbiting scroll 50.

The orbiting scroll 50 may include an orbiting plate 52 having certain thickness and area, an orbiting wrap 51 formed on the top face of the orbiting plate 52 to have certain thickness and height, and a boss portion 53 formed on the bottom face of the orbiting plate 52. The boss portion 53 may have a cavity 53*a*.

An oil flowing path 54 connected to the oil pipe 22 may be arranged inside the orbiting plate 52 that supports the orbiting wrap 51. Specifically, an oil supply port 55 moving together with the orbiting scroll 50 may be formed on one end of the oil flowing path 54. The other end of the oil flowing path 54 may be directed to the cavity 53*a* of the boss portion 53 to be connected to the oil pipe 22.

The oil supply port 55 may be shaped like an oil supply hole as shown in FIG. 3, without being limited thereto. For example, the oil supply port 55 may be formed in any shape, e.g., in the form of a slit.

Furthermore, the oil supply port 55 may be connected to the oil flowing path 54 through an additional arrangement for supplying oil onto the orbiting plate 52. The oil supply port 55 will be described as an oil supply hole in one of the embodiments of the present disclosure.

An orifice pin is arranged in the oil flowing path 54 to form a difference in pressure from outside the oil supply hole 55, enabling oil to pass the oil supply hole 55 and then to be discharged onto the orbiting scroll 50.

The fixed scroll 60 may include a body 62 formed to have a certain shape, a fixed wrap 61 formed inside the body 62 to have certain thickness and height, a discharging hole 63 formed to pass through the center of the body 62, and a suction hole 64 formed on one side of the body 62.

The fixed scroll 60 may further include a fixed plate 65 that protrudes from the body 62 and has a contact portion 66 to come into contact with the orbiting plate 52.

A contact portion may also be arranged on the orbiting plate 52. Specifically, the contact portion may be arranged on the orbiting plate 52 to be in contact with the contact portion 66 arranged on the fixed scroll 60 and to correspond to the contact portion 66 during orbit. For convenience of explanation, only the contact portion 66 arranged on the fixed scroll 60 will be described below.

An oil groove 100 may be formed in the contact portion 66 along the circumference of the fixed wrap 61. The oil groove 100 may be selectively connected to the oil supply hole 55 according to the orbiting motion of the orbiting scroll 50. The oil groove 100 may have a concave form to receive oil that has passed the oil supply hole 55. Details of the oil groove 100 will be described later.

An oil storage room 70 may be placed on the bottom of the inside of the main body 10. The lower end of the rotation shaft 21 extends to meet oil stored in the oil storage room 70 to move the oil upward through the oil pipe 22 formed in the axial direction of the rotation shaft 21.

The oil stored in the oil storage room 70 is pumped by an oil pump (not shown) installed at the lower end of the rotation shaft 21, and is moved up to the upper end of the rotation shaft 21 along the oil pipe 22 formed inside the rotation shaft 21. The oil reaching the upper end of the rotation shaft 21 may be contained in the oil storage 15*b*. The oil contained in the oil storage 15*b* is supplied as lubrication to between a bearing face 52*c* of the orbiting plate 52 and a bearing face 15*c* of the top flange 15 as the boss portion 53 of the orbiting scroll 50 orbits in the oil storage 15*b*.

Furthermore, a portion of the oil supplied to the bearing face 52*c* of the orbiting plate 52 and the bearing face 15*c* of the top flange 15 flows into the compressing chamber 41 formed by the orbiting wrap 51 of the orbiting scroll 50 and the fixed wrap 61 of the fixed scroll through the oil supply hole 55 formed to pass through the orbiting plate 52. As the oil is supplied into the compressing chamber 41 formed by the orbiting wrap 51 and the fixed wrap 61, leakage of pressure between the high pressure compressing chamber 41 and the low pressure compressing chamber 41 may be prevented by oil sealing. Moreover, it may reduce excessive friction occurring between the contacts of the orbiting scroll 50 and fixed scroll 60.

A portion of the oil flowing into the compressing chamber 41 through the oil supply hole 55 formed to pass through the orbiting plate 52 may be delivered to the Oldham's ring container 44 to prevent excessive loads being applied to the Oldham's ring 43.

The oil groove 100 will now be described in detail.

Figure 7:
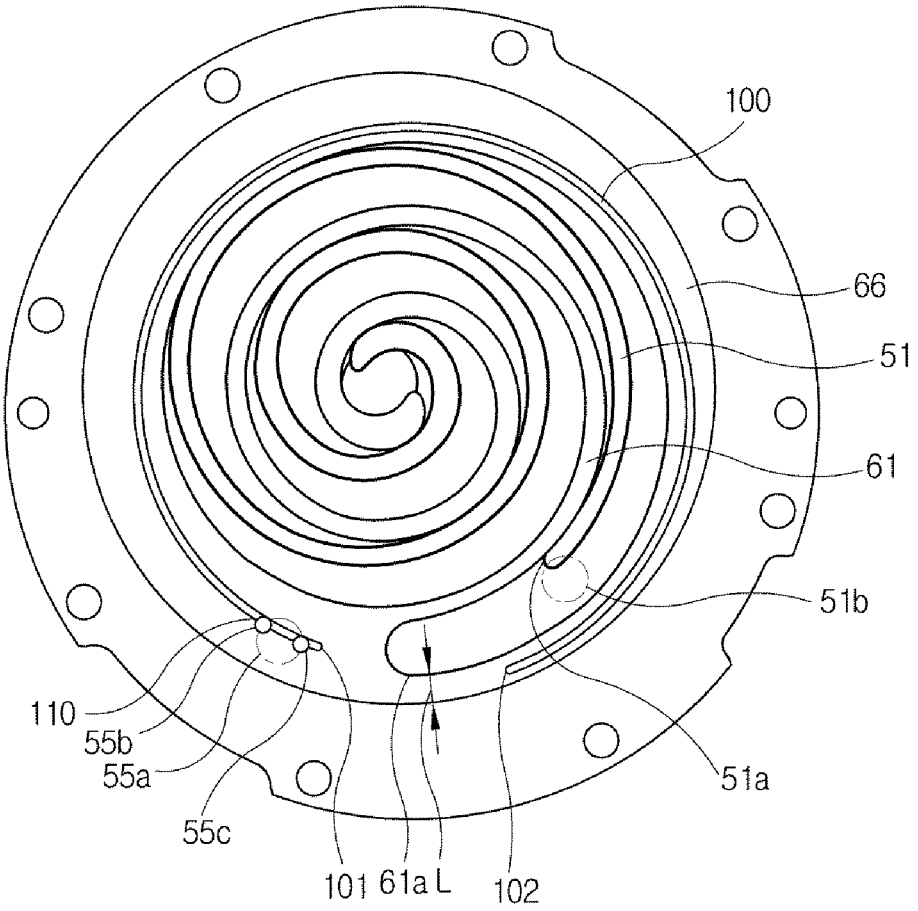
FIG. 7 illustrates a state in which a fixed scroll and an orbiting scroll of a compressor are orbiting, according to an embodiment of the present disclosure.

FIG. 7 illustrates a state in which a fixed scroll and an orbiting scroll of a compressor are orbiting, according to an embodiment of the present disclosure.

As described above, the oil groove 100 may be formed along the circumference of the fixed wrap 61 on the inner side of the contact portion 66. Specifically, the oil groove 100 may be formed to be closed on the inner side of the contact portion 66 in order for the oil that has passed the oil supply hole 55 to be dispersed all over the contact portion 66.

The oil groove 100 may be formed in a closed type where the oil groove 100 is formed to be closed on the inner side of the contact portion 66, and in an open type where at least part of the oil groove 100 that contains oil is opened to the outer side of the contact portion 66.

It is easier for the oil groove 100 of the closed type to remain at a certain pressure than the open type, because the oil groove 100 of the closed type is formed to be closed on the inner side of the contact portion 66. The oil groove 100 in accordance with an embodiment of the present disclosure will be assumed herein to be in the closed type.

The oil groove 100 may be formed across the contact portion 66 as wide as possible to reliably supply oil to the contact portion 66. The oil contained in the oil supply hole 55 flows along the entire oil groove 100, and is dispersed across the contact portion 66 near the oil groove 100 by friction occurring when the orbiting scroll 50 and the fixed scroll come into contact with each other.

Accordingly, the wider distribution the oil groove 100 has on the inner side of the contact portion 66, the easier it supplies oil all across the area of the contact portion 66, which leads to more reliable operation of the compressor 1.

To increase the capacity of the compressor 1, the compressing chamber 41 should be formed to have a large volume to discharge a large amount of refrigerants. As a method to expand the volume of the compressing chamber 41, there may be a method to increase the height of the volume of the compressing chamber 41 by extending the respective height of the orbiting wrap 51 and the fixed wrap 61, and a method to increase the cross-section of compression by extending the spiral shapes of the orbiting wrap 51 and the fixed wrap 61.

In the case of extending the respective height of the orbiting wrap 61 and the fixed wrap 61, the strength of the orbiting wrap 51 and fixed wrap 51 may become weak.

Accordingly, in the present disclosure, a method for forming a cross section of compression to increase the capacity of the compressor 1 may be designed. As the cross section of compression is formed to be wider, an outer end 61*a* of the fixed wrap 61 may be formed to extend into a large spiral shape toward the outer side of the fixed scroll 60.

Accordingly, a distance L between the outer end 61*a* of the fixed wrap 61 and an outer part of the contact portion 66 adjacent to the outer end 61*a* becomes short.

As the distance L becomes short, the oil groove 100 may not be able to extend to the part adjacent to the outer end 61*a* of the fixed wrap 61.

The oil groove 100 in accordance with the present disclosure has the closed type, and is located on the inner side of the contact portion 66, because, if the distance L is short, some of the oil groove 100 may be opened to the outside of the contact portion 66 when the oil groove 100 passes through between the outer end of the fixed wrap 61 and the outer part of the contact portion 66.

As described above, if the distance L is shorter than a minimum pass-through distance within which the oil groove 100 is able to pass through, the oil groove 100 may not reach a part of the contact portion 66 adjacent to the outer end 61*a* of the fixed wrap 61, so the oil may not be supplied to the part, or a small amount of the oil may be supplied, which leads to unreliable operation of the compressor 1 as a whole.

To solve this problem, the distance L may be designed to be larger by having the eccentricity of the orbiting motion moved from the center C of the contact portion 66 by a certain gap.

If the distance L is secured to be equal to or greater than the minimum pass-through distance within which the oil groove 100 is able to pass through, it is possible for the oil groove 100 to extend to a part adjacent to the outer end 61*a* of the fixed wrap 61 and thus to easily disperse the oil all across the area of the contact portion 66.

Accordingly, the oil groove 100 may be shaped like an arc, which is extended by being rotated around an arbitrary point formed on the contact portion 66 by 270 degrees or more.

Specifically, one end 101 of the oil groove 100 may be formed to be adjacent to the oil supply hole 55. On one side adjacent to the one end 101 of the oil groove 100, an oil supply portion 110 may be formed to be selectively connected to the oil supply hole 55 by coming into contact with an orbiting motion path of the oil supply hole 55.

The oil supply portion 110 may be formed to have a section that extends from the one end 101 of the oil groove 100 to an arbitrary side of the oil groove 100 on the way to the other end 102.

During the orbiting motion of the orbiting scroll 50, oil may be supplied when the oil supply portion 110 and the oil supply hole 55 may be connected for the first time at a first position 55*b* of the oil supply hole 55, which is engaged with the orbiting scroll 50 and orbits together with the orbiting scroll 50.

When the oil supply hole 55 orbits and is placed at a second position 55*c*, the oil supply portion 110 additionally receives oil by being connected for the second time to the oil supply hole 55.

The sequence of the first and second positions 55*b* and 55*c*, i.e., the order of positions coming into contact with the oil supply portion 110, is not limited thereto, but may be changed depending on the direction and starting point of the orbiting motion of the orbiting scroll 50.

After the oil supply portion 110 and the oil supply hole 55 are connected at the second position 55*c*, the oil supply portion 110 may be connected to the oil supply hole 55 back at the first position 55*b* according to the orbiting motion of the oil supply hole 55, and may then receive oil.

The oil supply portion 110 may be connected twice to the oil supply hole 55 to receive oil while the orbiting scroll 50 orbits once, and the oil contained in the oil supply portion 110 may flow to the other end 102 of the oil groove 100 by friction of the orbiting plate 52 of the orbiting scroll 50, which is produced while the orbiting scroll 50 orbits, and a difference in pressure between the oil supply portion 110 and the other end 102 of the oil groove 100.

As described above, if the distance L is formed to be equal to or greater than the minimum distance within which the oil groove 100 is able to pass through, the other end 102 of the oil groove 100 is rotated and extended to a part adjacent to the outer end 61*a* of the fixed wrap 61.

For example, the other end 102 of the oil groove 100 may be extend and shaped like an arc by being rotated around an arbitrary point on the contact portion 66 (preferably, a point adjacent to the center C of the contact portion 66) from the one end 101 by 270 degrees or more.

Accordingly, if the other end 102 of the oil groove 100 is extended by being rotated by 270 degrees or more with respect to the one end 101, oil may flow to a part adjacent to the outer end 61*a* of the fixed wrap 61 along the oil groove 100 and may be dispersed from the part adjacent to the outer end 61*a* of the fixed wrap 61, thereby being smoothly provided to the outer end 61*a* of the fixed wrap 61.

A distance between the other end 102 of the oil groove 100 and the oil supply hole 55 may be formed to be shorter than the distance between the outer end 51*a* of the orbiting wrap 51 and the oil supply hole 55.

Specifically, a distance from the other end 102 of the oil groove 100 to the oil supply hole 55 in an arbitrary orbiting position on the orbit path 55*a* may be formed to be shorter than the distance between the outer end 51*a* of the orbiting wrap 51 and the oil supply hole 55. Alternatively, the other end 102 of the oil groove 100 may be extended to cover the orbit path 51*b* of the outer end 51*a* of the orbiting wrap 51 from the outside of the orbiting wrap 51.

In order for the distance between the other end 102 of the oil groove 100 and the oil supply hole 55 to be formed shorter than the distance between the outer end 51*a* of the orbiting wrap 51 and the oil supply hole 55, the other end 102 of the oil groove 100 needs to be rotated around an arbitrary point located inner side of the contact portion 66 by about 270 degrees or more with respect to the one end 101 of the oil groove 100.

In the case that the distance between the other end 102 of the oil groove 100 and the oil supply hole 55 is formed shorter than the distance between the outer end 51*a* of the orbiting wrap 51 and the oil supply hole 55, the oil groove 100 may be extended to cover approximately all the area of the contact portion 66, thereby supplying oil smoothly to the inner side of the contact portion 66.

Furthermore, the oil contained in the oil groove 100 may be supplied to the contact portion 66 during orbit, thereby reducing friction between the fixed scroll 60 and the orbiting scroll 60, and a portion of the oil may flow to the inside of the compressing chamber 41, thereby reducing friction between the fixed wrap 61 and the orbiting wrap 51.

Accordingly, if the orbit path 51*b* of the outer end 51*a* of the orbiting wrap 51 is covered by the oil groove 100, oil may easily flow across the entire area of the compressing chamber 41 formed by the orbiting wrap 51 and the fixed wrap 61.

An oil groove 100*a* in accordance with another embodiment of the present disclosure will now be described. The structure of the compressor 1 exclusive of the oil groove 100*a* and associated components, which will be described below, is the same as what is described above about the compressor 1, so the description will be omitted herein.

Figure 8:
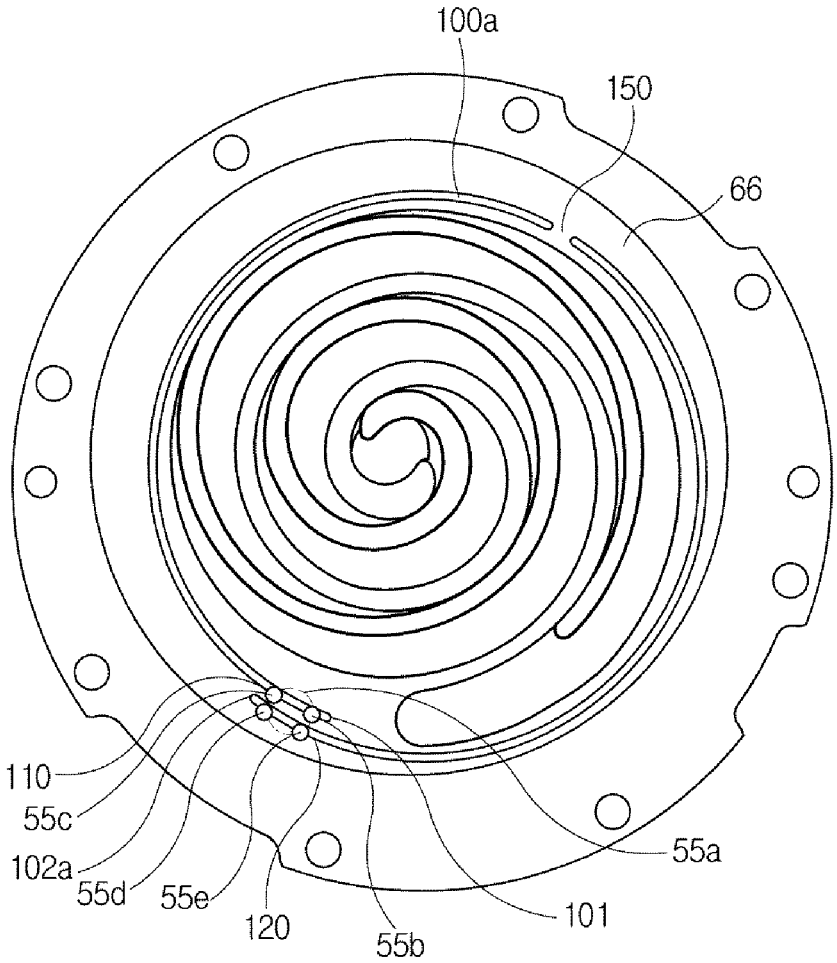
FIG. 8 illustrates a state in which a fixed scroll and an orbiting scroll of a compressor are orbiting, according to another embodiment of the present disclosure.

FIG. 8 illustrates a state in which a fixed scroll and an orbiting scroll of a compressor are orbiting, according to another embodiment of the present disclosure.

As described above, with respect to the one end 101 of the oil groove 100*a*, the other end 102*a* of the oil groove 100*a* is rotated and extended by 270 degrees or more, or even 360 degrees or more.

Specifically, the oil groove 100*a* may be rotated and extended in a spiral form like the orbiting wrap 51 and the fixed wrap 61, wherein the other end 102*a* of the oil groove 100*a* may be rotated by 360 degrees or more with respect to the one end of the oil groove 100*a*, thus being extended to the outside of the one end of the oil groove 100*a*.

The other end 102*a* of the oil groove 100*a* may be arranged to be adjacent to the oil supply hole 55. A side adjacent to the other end 102*a* of the oil groove 100*a* may be formed to pass the orbit path 55*a*, and to be connected to the oil supply hole 55 twice or more when the oil supply hole 55 orbits once.

When the oil supply portion 110 arranged on one end 101 of the oil groove 100*a* is called a first oil supply portion 110, a second oil supply portion 120 may be additionally arranged on the other end 102*a* of the oil groove 100*a*.

The second oil supply portion 120 may be formed to have a section that extends from the other end 102*a* of the oil groove 100*a* to an arbitrary side of the oil groove 100*a* on the way to the one end 101.

Specifically, the second oil supply portion 120 may be arranged in the orbit path 55*a* of the oil supply hole 55 to contain oil by being connected to the oil supply hole 55 at least twice or more during orbit.

For example, due to orbiting movement of the oil supply hole 55, the oil supply hole 55 may pass the first position 55*b* and second position 55*c* with the first oil supply portion 110, and may be connected to the second oil supply portion 120 once by orbiting onto a third position 55*d*. The oil supply hole 55 may then orbit again, move to a fourth position 55*e*, and may be connected to the second oil supply portion 120 twice.

Since the first and second oil supply portions 110 and 120 may be connected to the oil groove 100*a* four times or more while the oil supply hole 55 orbits once, more oil may flow into the oil groove 100*a* than when there is a single oil supply portion 110, and thus the oil may be supplied more smoothly to the contact portion 66.

Furthermore, since the other end 102*a* of the oil groove 100*a* is rotated and extended by 360 degrees or more with respect to the one end 101, the oil groove 100*a* may be able to fully cover the contact portion 66 and may thus easily disperse oil across the entire area of the contact portion 66.

An incision portion 150 may be formed on one side of the oil groove 100*a* to cut the oil groove 100*a*. Specifically, the incision portion 150 may be formed on one side in the section of the oil groove 100*a* formed between the first and second oil supply portions 110 and 120.

The oil groove 100*a* may receive oil from the first and second oil supply portions 110 and 120 arranged on either ends of the oil groove 100*a*, and the oil may flow along the groove. Accordingly, both the ends of the oil groove 100*a*, which are adjacent to the incision portion 150, may receive oil from the oil supply portions 110 and 120 connected thereto, and may disperse the oil to the inner side of the contact portion 66.

An oil groove 100*b* in accordance with another embodiment of the present disclosure will now be described. The structure of the compressor 1 exclusive of the oil groove 100*b* and associated components, which will be described below, is the same as what is described above about the compressor 1, so the description will be omitted herein.

Figure 9:
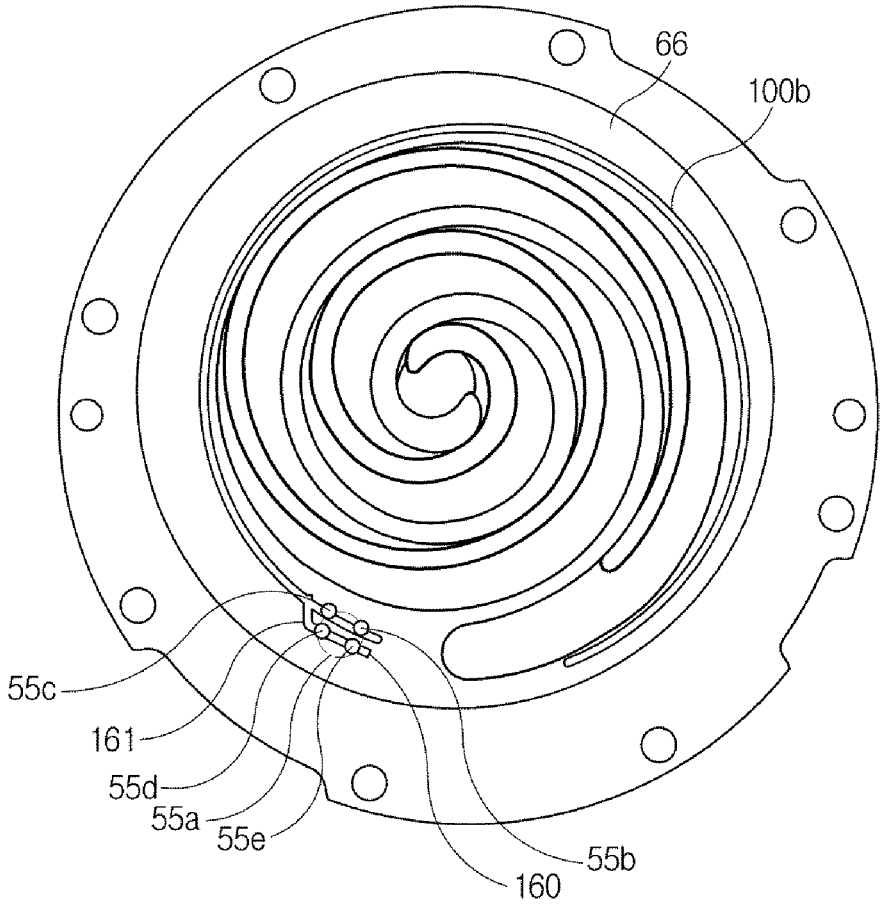
FIG. 9 illustrates a state in which a fixed scroll and an orbiting scroll of a compressor are orbiting, according to another embodiment of the present disclosure.

FIG. 9 illustrates a state in which a fixed scroll and an orbiting scroll of a compressor are orbiting, according to another embodiment of the present disclosure.

An auxiliary oil groove 160 extending from the oil groove 100*b* may be formed on a side adjacent to the one end 101 of the oil groove 100*b*.

Like the oil groove 100*b*, the auxiliary oil groove 160 may have a concave form to receive oil supplied from the oil supply hole 55. The auxiliary oil groove 160 may be formed such that the oil groove 100*b* may protrude and extend to the inner side or outer side of the oil groove 100*b*.

The auxiliary oil groove 160 may be formed to pass through the orbit path of the oil supply hole 55. That is, it may be formed to extend from a side adjacent to the oil supply portion 110 so as to be selectively connected to the oil supply hole 55.

As shown in FIG. 9, the auxiliary oil groove 160 may be formed to extend outward of the oil groove 100*b* and to be bent by a bending portion 161 toward the orbit path of the oil supply hole 55.

Accordingly, the section of the auxiliary oil groove 160 bent by the bending portion 161 may be selectively connected to the oil supply hole 55 to receive oil.

The oil supply hole 55 may be connected to the oil groove 100*b* to supply oil while sequentially passing the first position 55*b* and the second position 55*c* by orbiting movement, and may pass the third and fourth positions 55*d* and 553 by the orbiting movement. The oil supply hole 55 may be connected to the auxiliary oil groove 160 to supply oil when reaching the third position 55*d* or the fourth position 55*e*.

The oil supplied from the oil supply hole may be contained in the auxiliary oil groove 160, may flow through the bending portion 161 to a point where the oil groove 100*b* and the auxiliary oil groove 160 join, and may flow to the oil groove 100*b*.

As described above, the oil supply hole 55 may be connected to the oil groove 100*b* at least twice or more and to the auxiliary oil groove 160 at least twice or more, and thus may supply oil to the oil groove 100*b* four times or more while orbiting once.

Therefore, more oil may flow into the oil groove 100*b* with the auxiliary oil groove 160 than without, and accordingly, oil supply to the contact portion 66 may be performed more smoothly.

The shape of the auxiliary oil groove 160 is not limited to what is described above. For example, with a plurality of bending portions 161, the oil supply hole 55 and the auxiliary oil groove 160 may be connected to each other three times or more while the oil supply hole 55 orbits once.

Alternatively, the auxiliary oil groove 160 may not include any bending portion 161 in another embodiment of the present disclosure. In this case, the auxiliary oil groove 160 and the oil groove 100*b* may be arranged in the form of 'T'. The auxiliary oil groove 160 may be formed in the orbit path of the oil supply hole 55 such that it may be connected to the oil supply hole 55 one time while the oil supply hole 55 orbits once.

An oil groove 100*c* in accordance with another embodiment of the present disclosure will now be described. The structure of the compressor 1 exclusive of the oil groove 100*c* and associated components, which will be described below, is the same as what is described above about the compressor 1, so the description will be omitted herein.

Figure 10:
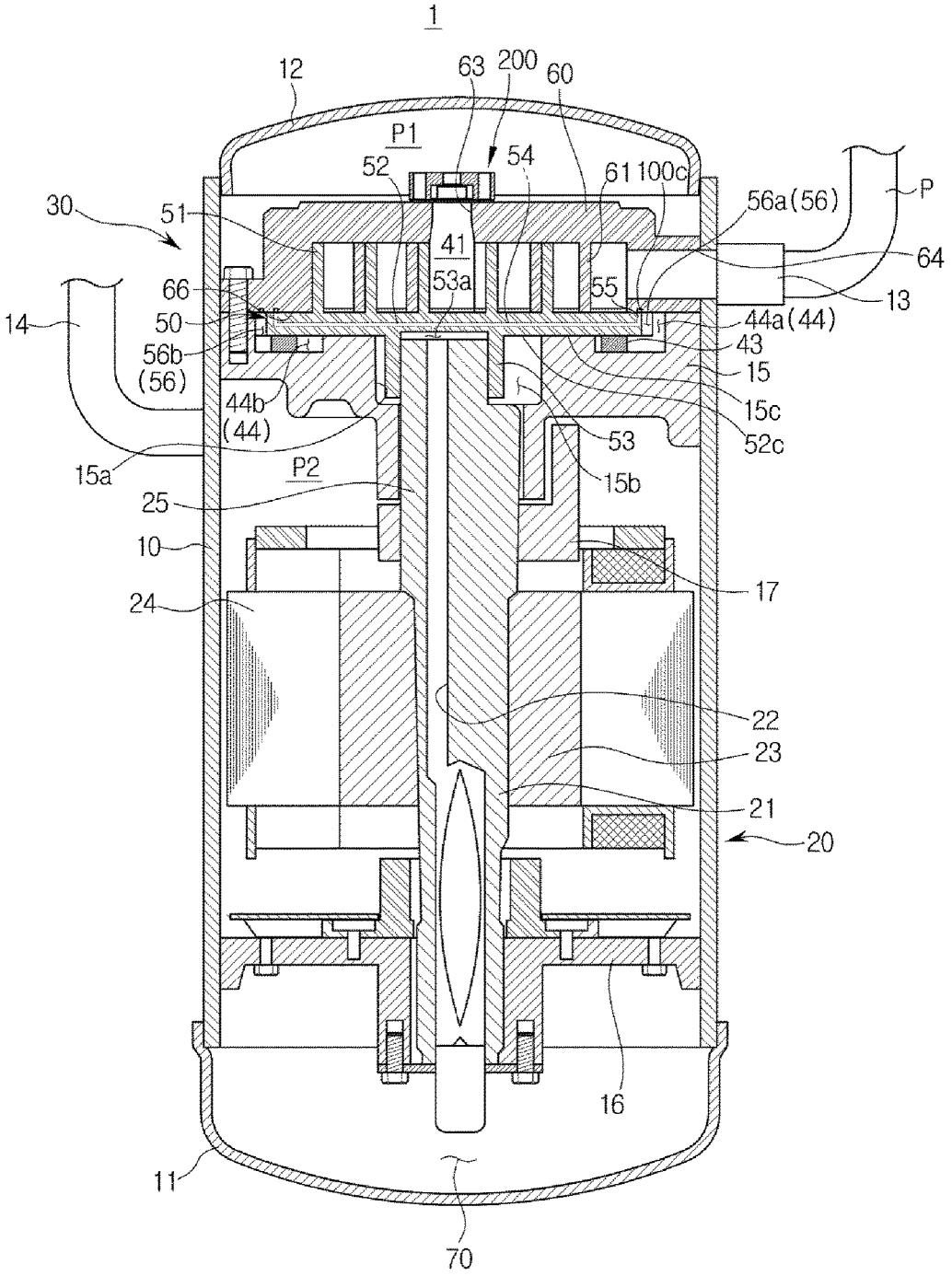
FIG. 10 illustrates a side cross-sectional view of a compressor, according to another embodiment of the present disclosure.
Figure 11:
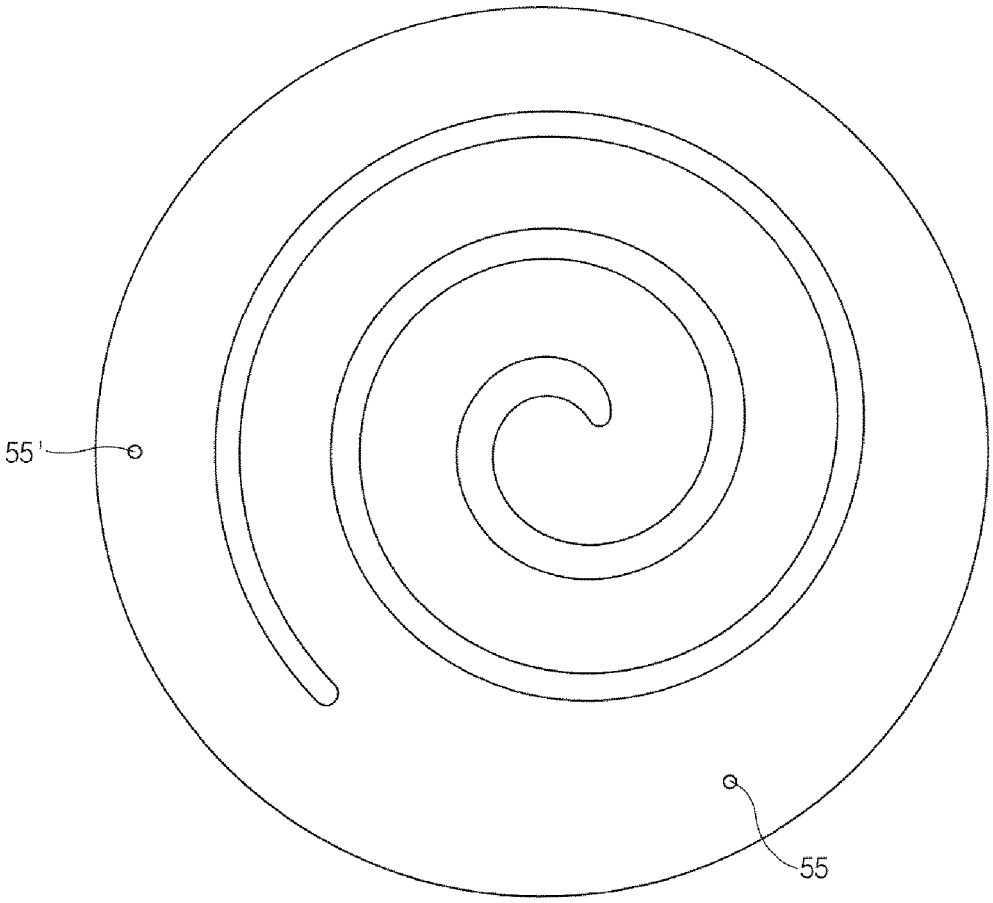
FIG. 11 illustrates a plan view of an orbiting scroll of a compressor, according to another embodiment of the present disclosure.
Figure 12:
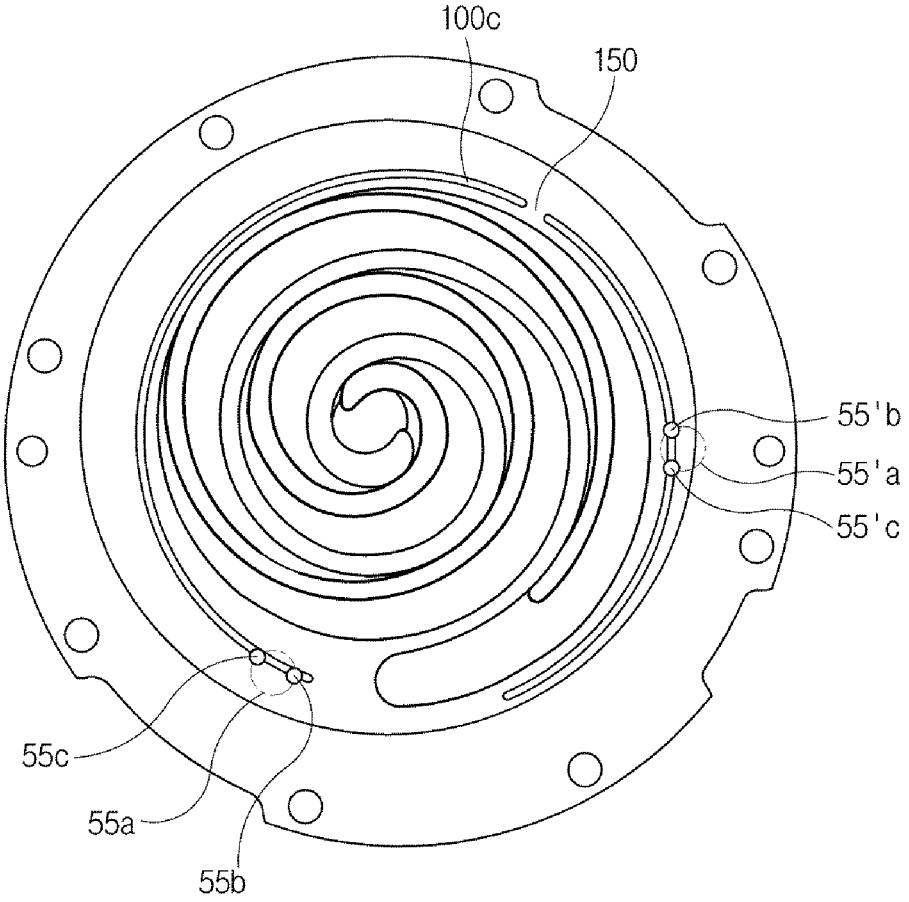
FIG. 12 illustrates a state in which a fixed scroll and an orbiting scroll of a compressor are orbiting, according to another embodiment of the present disclosure.

FIG. 10 illustrates a side cross-sectional view of the compressor 1, according to another embodiment of the present disclosure, FIG. 11 illustrates a plan view of the orbiting scroll 50 of the compressor 1, according to another embodiment of the present disclosure, and FIG. 12 illustrates a state in which the fixed scroll 60 and the orbiting scroll 50 of the compressor 1 are orbiting, according to another embodiment of the present disclosure.

In contrast to what is described above, there may be a plurality of oil supply holes 55 arranged on inner side of the orbiting plate 52. For example, the compressor 1 may include a first oil supply hole 55 and an additional second oil supply hole 55'.

The second oil supply hole 55' may be formed separately from the first oil supply hole 55 on the orbiting plate 52. Specifically, the first and second oil supply holes 55 and 55' may be formed on the inner side of the contact portion 66 to supply oil to the contact portion 66, thereby enabling the compressor 1 to be reliably operated.

The oil flowing path 54 connected to the oil pipe 22 may be extended to supply oil to the first oil supply hole 55 and/or to the second oil supply hole 55'. Specifically, one end of the oil flowing path 54 is connected to the oil pipe 22, and a branching section may be formed on one side of a section from end to end of the oil flowing path 54, thereby forming a plurality of the other ends of the oil flowing path 54.

The plurality of the other ends of the oil flowing path 54 may be connected to the first and second oil supply holes 55 and 55', thereby supplying oil to the orbiting plate 52.

The oil groove 100*c* may be formed to pass through all the first and second oil supply holes 55 and 55'.

The oil groove 100*c* may be connected to each of the first oil supply hole 55 and the second oil supply hole 55' at least twice while the orbiting scroll 50 orbits once, and may thus receive oil from the oil supply holes 55, 55' four times or more.

In other words, the first and second oil supply holes 55, 55' work with the orbiting scroll 50 and orbit while the orbiting scroll 50 orbits, and the oil groove 100*c* may receive oil by being connected to the first oil supply hole 55 at the first and second positions 55*b* and 55*c* of the first oil supply hole 55, and simultaneously, receive oil by being connected to the second oil supply hole 55' at first and second positions 55'*b* and 55'*c*, while the orbiting scroll 50 orbits once.

The oil groove 100*c* may be connected to the first and second oil supply holes 55, 55' by coming into contact with the first and second oil supply holes 55, 55' at the same time or with a time gap.

A valve unit 200 of the compressor 1 will now be described in detail.

Figure 13:
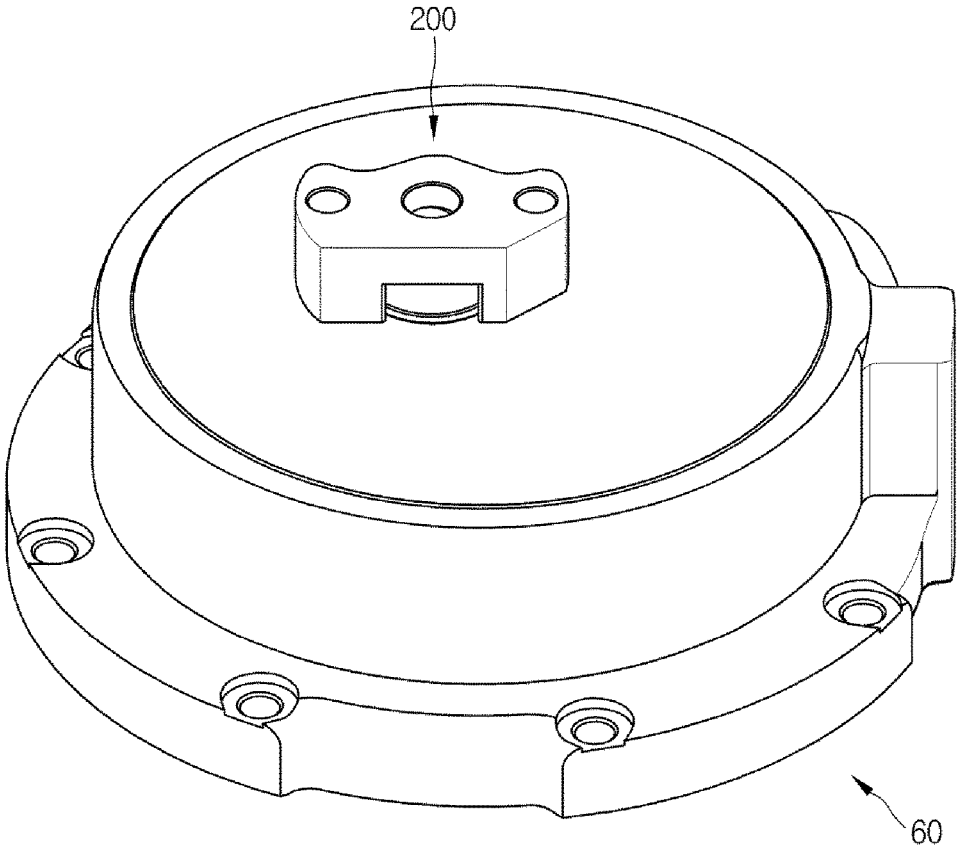
FIG. 13 illustrates a fixed scroll and a valve unit of a compressor, according to an embodiment of the present disclosure.
Figure 14:
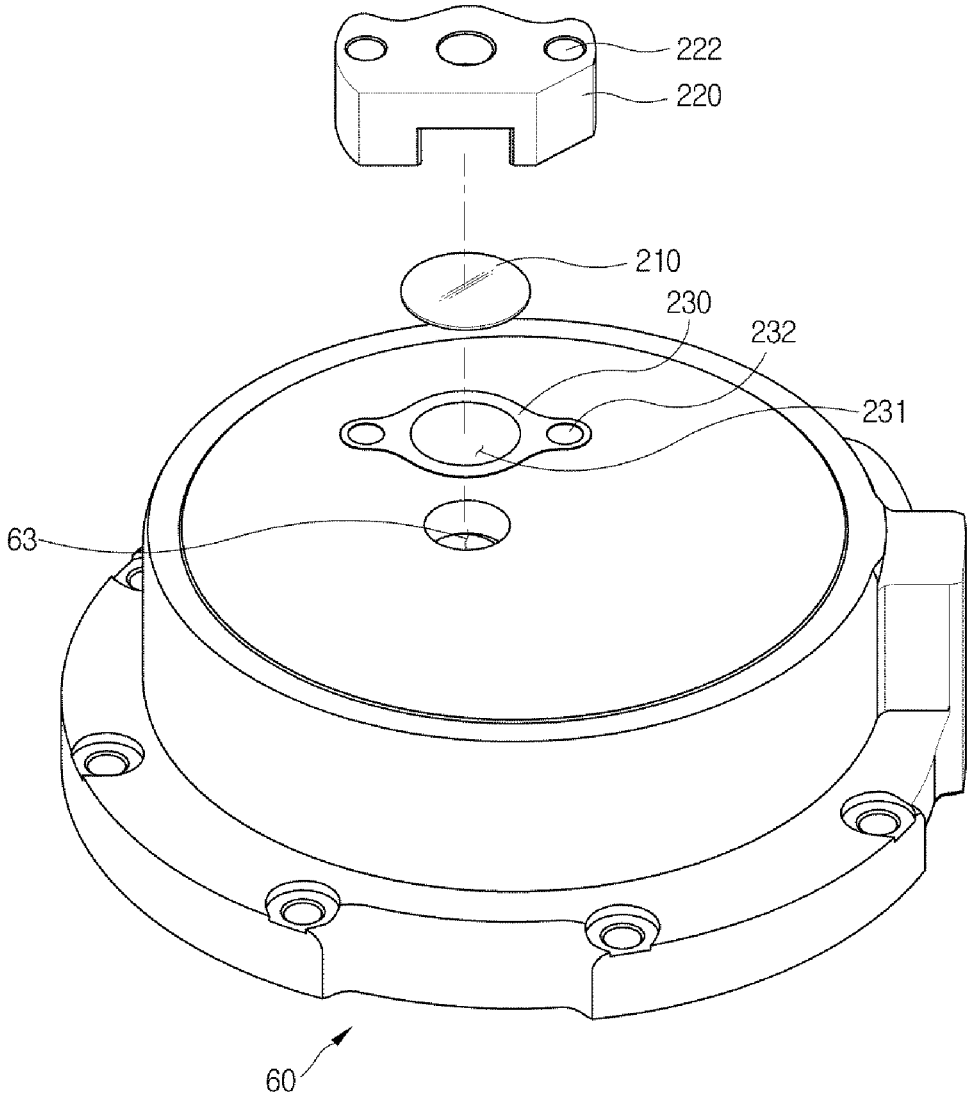
FIG. 14 illustrates an exploded view of a valve unit of a compressor, according to an embodiment of the present disclosure.
Figure 15:
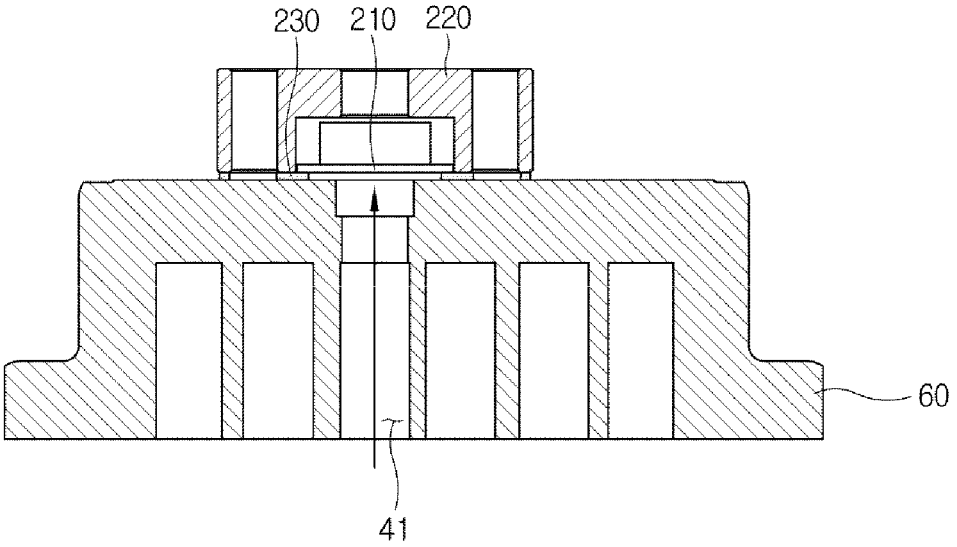
FIG. 15 illustrates a state before refrigerants are discharged from a compressing chamber of a compressor, according to an embodiment of the present disclosure.
Figure 16:
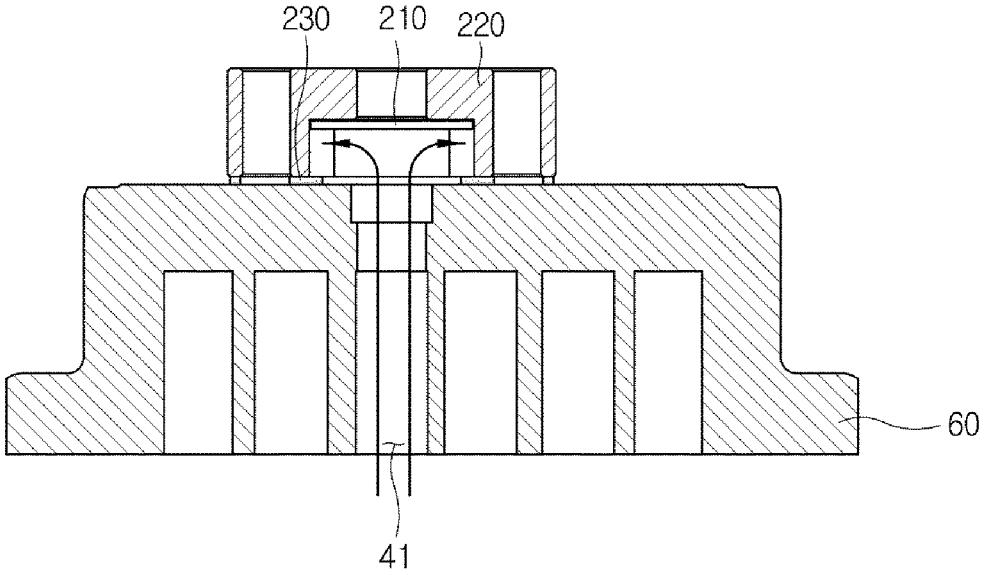
FIG. 16 illustrates a state in which refrigerants are discharged from a compressing chamber of a compressor, according to an embodiment of the present disclosure.
Figure 17:
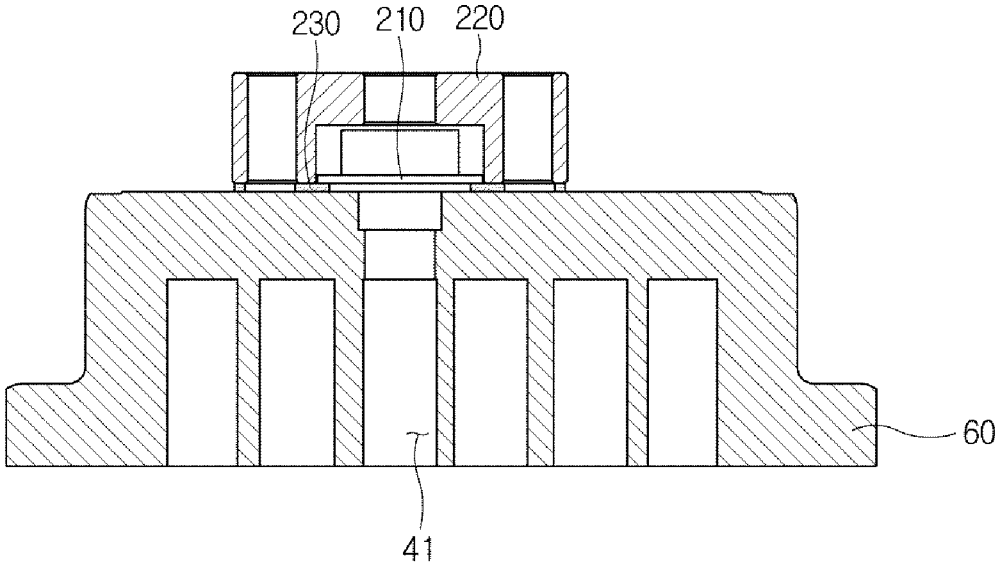
FIG. 17 illustrates a state after refrigerants are discharged from a compressing chamber of a compressor, according to an embodiment of the present disclosure.

FIG. 13 illustrates a fixed scroll and a valve unit of a compressor, according to an embodiment of the present disclosure, FIG. 14 illustrates an exploded view of a valve unit of a compressor, according to an embodiment of the present disclosure, FIG. 15 illustrates a state before refrigerants are discharged from a compressing chamber of a compressor, according to an embodiment of the present disclosure, FIG. 16 illustrates a state in which refrigerants are discharged from a compressing chamber of a compressor, according to an embodiment of the present disclosure, and FIG. 17 illustrates a state after refrigerants are discharged from a compressing chamber of a compressor, according to an embodiment of the present disclosure.

While moving toward the center of the fixed scroll 60 and the orbiting scroll 50 as the orbiting scroll 50 orbits, refrigerants in the compressing chamber 41 decrease in volume and accordingly, increases in pressure, thus becoming high-pressure and high-temperature refrigerants.

The high-pressure and high-temperature refrigerants may be discharged from the compressing chamber 41 up to the top of the compressor 1 through the discharging hole 63 formed on the upper side of the center of the fixed scroll 60, and may be discharged out of the compressor 1 through the outlet 14.

During operation of the compressor 1, high-pressure and high-temperature refrigerants may be produced through the motions where the compressing chamber 41 decreases in volume as it moves toward the center through orbiting motion of the orbiting scroll 50, and the refrigerants may be discharged out of the discharging hole 63 due to a difference in pressure between the compressing chamber 41 and the outside of the discharging hole 63.

When the compressor 1 stops operating, the difference in pressure between the compressing chamber 41 and the outside of the discharging hole 63 decreases, which may cause the high-temperature and high pressure refrigerants to flow backward to the compressing chamber 41 through the discharging hole 63.

To prevent this, a valve unit 200 may be arranged above the discharging hole 63. The valve unit 200 may include a valve 210 that moves up and down above the discharging hole 63 by discharging of refrigerants, a valve guide 220 that guides movement of the valve 210, a buffer member 230 located above the fixed scroll 60 and below the valve 210.

The valve guide 220 may guide the movement path of the valve 210 such that the valve 210 moves up and down. Specifically, a room is formed inside the valve guide 220 for the valve 210 to be moved, and the movement path of the valve 210 may be formed in the room for the valve 210 to move up and down.

The valve 210 may be moved up and down alternately above the discharging hole 63 while refrigerants are being discharged. If the compressor 1 is put under an inordinate operating condition, such as being operated at high-speed or high-temperature, it may discharge refrigerants too fast, thereby leading to excessive up and down movements of the valve 210.

This makes the operation of the valve 210 unstable, in which case the valve 210 may excessively strike the top of the fixed scroll 60 located adjacent to the discharging hole 63. This may significantly wear out the top of the fixed scroll 60, which may degrade reliability in operation of the compressor 1.

To prevent this, the buffer member 230 may be arranged between the valve 210 and the top of the fixed scroll 60.

When the valve 210 moves down, it strikes the buffer member 230 instead of the top of the fixed scroll 60, which prevents the fixed scroll 60 from wearing out, thereby improving the durability of the compressor 1 and securing reliability in operation of the compressor 1.

The buffer member 230 may include a through tube 231 formed for refrigerants discharged from the discharging hole 63 to pass through. High-temperature and high-pressure refrigerants passing the through tube 231 may strike the valve 210 upward and separate the discharging hole 63 from the valve 210.

The buffer member 230 may be assembled with the valve guide 220 on the top of the fixed scroll 60. First assembling holes 222 formed in the valve guide 220 and second assembling grooves 232 formed in the buffer member 230 may correspond to each other and may be fastened by bolts or rivets, or may be bonded with an adhesive.

The buffer member 230 may include a material having high rigidity to prevent itself from wearing out by striking of the valve 210. Preferably, the material that forms the buffer member 230 may have rigidity of HRC (Rockwell, Scale C) 40 or more.

Furthermore, since the valve 210 strikes the bottom of the valve guide 220 when moving up, the valve guide 220 may be formed by hardening and heat treatment to prevent abrasion by striking. The valve guide 220 may also be formed with rigidity of HRC 40 or more.

A process of opening/shutting the valve unit 200 will now be described.

Referring to FIG. 15, before refrigerants are discharged, the valve 210 is located down to keep the discharging hole 63 shut. Then, when the compressor 1 is driven, high-temperature and high-pressure refrigerants flow to the center of the compressing chamber 41 and even to the discharging hole 63.

Referring to FIG. 16, the high-temperature and high-pressure refrigerants flowing to the discharging hole 63 press the valve 210 upward by striking the bottom of the valve 210 formed to be adjacent to the discharging hole 63.

As the valve 210 is pressed upward, it may be moved upward and separated from the discharging hole 63, thereby making an open section between the valve 210 and the discharging hole 63. The refrigerants may pass the discharging hole 63 and may be discharged out of the fixed scroll 60 through the open section.

Referring to FIG. 17, in the case the operation of the compressor 1 is stopped and no refrigerants are discharged from the compressing chamber 41, the valve 210 is moved down again and placed in a position to shut the discharging hole 63. As the valve 210 is moving downward, it strikes the fixed scroll 60 and may cause the fixed scroll 60 to wear out. Thus, the buffer member 230 is arranged between the valve 210 and the top of the fixed scroll 60 to prevent the fixed scroll 60 from wearing out.

According to embodiments of the present disclosure, a compressor is configured for an oil groove located on a part where a fixed scroll and an orbiting scroll rub against each other to effectively supply oil to the part, thereby improving reliability in operation of the compressor.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A compressor comprising:

a main body;

a fixed scroll fixed on the inside of the main body;

an orbiting scroll arranged to orbit relative to the fixed scroll;

a compressing chamber formed by the fixed scroll and the orbiting scroll;

an oil supply hole configured to supply oil to a contact portion formed by the fixed scroll and the orbiting scroll; and an oil groove formed on an inner side of the contact portion to be closed to an outer side of the contact portion, wherein the oil groove is extended into an arc by being rotated by about 270 degrees or more along a circumference of the fixed scroll to cover the compressing chamber from outside of the compressing chamber;

wherein one end of the oil groove is formed to be adjacent to the oil supply hole, and an oil supply portion adjacent to the one end of the oil groove that comes into contact with the oil supply hole at least twice while the orbiting scroll orbits; and wherein the oil groove further comprises an auxiliary oil groove that is extended from a side of the oil supply portion and comes into contact with the oil supply hole at least once while the orbiting scroll orbits.

2. The compressor of claim 1, wherein the auxiliary oil groove comprises at least one bending portion that bends to a side from a direction where the auxiliary oil groove extends from the oil groove.

3. The compressor of claim 2, wherein the auxiliary oil groove is bent to come into contact with the oil supply hole at least twice while the orbiting scroll orbits.

4. The compressor of claim 1, wherein an other end of the oil groove is rotated and extended to a position corresponding to the oil supply portion.

5. The compressor of claim 4, wherein the oil supply portion comprises a plurality of oil supply portions including a first oil supply portion arranged on the one end of the oil groove and a second oil supply portion formed on the other end of the oil groove and located to correspond to the first oil supply portion.

6. The compressor of claim 5, wherein the oil groove further comprises an incision portion located between the first oil supply portion and the second oil supply portion for cutting the oil groove.

7. The compressor of claim 1, wherein the oil supply hole comprises a plurality of oil supply holes including a first oil supply hole formed on the orbiting scroll and a second oil supply hole formed separately from the first oil supply hole, wherein the oil groove is formed to come into contact with each of the first oil supply hole and the second oil supply hole at least twice while the orbiting scroll orbits.

8. The compressor of claim 7, wherein the oil groove further comprises an incision portion located between the first oil supply hole and the second oil supply hole for cutting the oil groove.

9. The compressor of claim 1, further comprising:

a discharging hole formed above the fixed scroll configured to discharge refrigerants compressed by the compressing chamber, and a valve unit formed above the discharging hole configured to prevent discharged refrigerants from flowing backward to the discharging hole while operation of the compressor is stopped.

10. The compressor of claim 9, wherein the valve unit comprises a valve configured to prevent the refrigerants from flowing backward by moving up and down alternately from the discharging hole;

a valve guide configured to guide the valve; and a buffer member arranged between the discharging hole and the valve.

11. The compressor of claim 10, wherein the valve is configured to move up and down alternately between the valve guide and the buffer member.

12. The compressor of claim 10, wherein the buffer member comprises a through tube where the refrigerants discharged from the discharging hole pass through.

13. A compressor comprising:

a main body;

a fixed scroll that is fixed on an inside of the main body and has a fixed wrap;

an orbiting scroll that orbits relative to the fixed scroll and includes an orbiting wrap to form a compressing chamber with the fixed wrap;

an oil supply hole configured to supply oil to a contact portion formed by the fixed scroll and the orbiting scroll; and an oil groove formed on an inner side of the contact portion to be closed on the contact portion, one end of the oil groove being adjacent to the oil supply hole, and an other end of the oil groove being rotated and extended to an outer side of the compressing chamber, wherein a distance between the other end of the oil groove and the oil supply hole is formed to be shorter than a distance between an outer end of the orbiting wrap and the oil supply hole wherein an oil supply portion adjacent to the one end of the oil groove comes into contact with the oil supply hole at least twice while the orbiting scroll orbits; and wherein the oil groove further comprises an auxiliary oil groove that is extended from a side of the oil supply portion and comes into contact with the oil supply hole at least once while the orbiting scroll orbits.

14. The compressor of claim 13, wherein the other end of the oil groove is extended by being rotated by about 270 degrees or more with respect to the one end of the oil groove.

15. The compressor of claim 13, wherein the other end of the oil groove is rotated and extended to a position corresponding to an orbit path of the oil supply hole.

16. The compressor of claim 13, further comprising:

a discharging hole formed above the fixed scroll configured to discharge refrigerants compressed by the compressing chamber, and a valve unit formed above the discharging hole configured to prevent the discharged refrigerants from flowing backward to the discharging hole while operation of the compressor is stopped.

* * * * *